US010233410B2

(12) United States Patent
Gott et al.

(10) Patent No.: US 10,233,410 B2
(45) Date of Patent: Mar. 19, 2019

(54) MINIMUM BOILING AZEOTROPE OF N-BUTYL-3-HYDROXYBUTYRATE AND N-UNDECANE AND APPLICATION OF THE AZEOTROPE TO SOLVENT CLEANING

(71) Applicant: Eastman Chemical Company, Kingsport, TN (US)

(72) Inventors: Travis Matthew Gott, Kingsport, TN (US); Venkata Bharat Ram Boppana, Denver, NC (US)

(73) Assignee: Eastman Chemical Company, Kingsport, TN (US)

( * ) Notice: Subject to any disclaimer, the term of this patent is extended or adjusted under 35 U.S.C. 154(b) by 4 days.

(21) Appl. No.: 15/624,128

(22) Filed: Jun. 15, 2017

(65) Prior Publication Data

US 2018/0362894 A1 Dec. 20, 2018

(51) Int. Cl.

| | |
|---|---|
| ***C11D 7/50*** | (2006.01) |
| ***C11D 3/43*** | (2006.01) |
| ***C11D 1/66*** | (2006.01) |
| ***C23G 5/02*** | (2006.01) |

(52) U.S. Cl.
CPC ..... *C11D 3/43* (2013.01); *C11D 1/667* (2013.01); *C23G 5/02* (2013.01)

(58) Field of Classification Search
CPC ..... C11D 7/5031
USPC ..... 510/407, 408, 411
See application file for complete search history.

(56) References Cited

U.S. PATENT DOCUMENTS

| | | | | |
|---|---|---|---|---|
| 2,803,676 A | | 8/1957 | Willis | |
| 3,772,157 A | | 11/1973 | Horsley | |
| 3,881,949 A | | 5/1975 | Brock | |
| 3,898,195 A | | 8/1975 | Beckers | |
| 4,289,542 A | | 9/1981 | Roehl | |
| 4,341,567 A | | 7/1982 | Roehl | |
| 4,473,444 A | * | 9/1984 | Feldman | B01D 3/40 203/69 |
| 4,654,160 A | | 3/1987 | Wilson et al. | |
| 5,114,495 A | | 5/1992 | Mainz | |
| 5,116,525 A | | 5/1992 | Merchant | |
| 5,196,136 A | * | 3/1993 | Dishart | C11D 3/2093 510/175 |
| 5,792,277 A | | 8/1998 | Shubkin | |
| 6,130,195 A | | 10/2000 | Doyel et al. | |
| 6,417,153 B1 | * | 7/2002 | Owens | C09K 5/045 510/411 |

(Continued)

FOREIGN PATENT DOCUMENTS

| | | |
|---|---|---|
| CN | 102 304 443 A | 1/2012 |
| EP | 0 347 924 A1 | 12/1989 |
| EP | 0 702 080 A2 | 3/1996 |
| JP | 53 059607 A | 5/1978 |

(Continued)

OTHER PUBLICATIONS

Chen, Geng-Hua et al.; "Study and applications of binary and ternary azeotropes"; Thermochimica Acta, 253; 1995; pp. 295-305.

(Continued)

*Primary Examiner* — Gregory E Webb
(74) *Attorney, Agent, or Firm* — Matthew W. Smith

(57) ABSTRACT

A novel minimum boiling binary azeotrope of n-undecane and n-butyl-3-hydroxybutyrate is shown to have utility as a solvent for degreasing of both nonpolar and polar contaminants. The components of the azeotrope are stable against degradation and the composition is largely invariant with pressure, yielding a unique solvent that can be used in cold cleaning and in vapor degreasing at elevated temperatures and over a wide range of pressures.

12 Claims, 4 Drawing Sheets

(56) References Cited

U.S. PATENT DOCUMENTS

| | | | |
|---|---|---|---|
| 8,877,087 | B2 | 11/2014 | Marhold et al. |
| 9,034,108 | B2 | 5/2015 | Geissler |
| 9,163,202 | B2 | 10/2015 | De Wit |

FOREIGN PATENT DOCUMENTS

| | | | |
|---|---|---|---|
| JP | H09 59680 | A | 3/1997 |
| WO | WO 96 23088 | A1 | 8/1996 |
| WO | WO 2005 110957 | A2 | 11/2005 |
| WO | 2016/080133 | A1 | 5/2016 |

OTHER PUBLICATIONS

Horstmann, Sven et al.; "Vapor-Liquid-Liquid Equilibria, Azeotropic, and Excess Enthalpy Data for the Binary System n-Undecane + Propionamide and Pure-Component Vapor Pressure and Density Data for Propionamide"; J. Chem. Eng. Data, 49; 2004; pp. 1494-1498.

Meissner, H. P. and Greenfeld, S. H.; "Composition and Boiling Points of Binary Azeotropes"; Industrial & Engineering Chemistry, vol. 40, No. 3; Mar. 1948; pp. 438-442.

Solov'ev, Vitaly P.; "Quantitative Structure-Property Relationship (QSPR) Modeling of Normal Boiling Point Temperature and Composition of Binary Azeotropes"; Industrial & Engineering Chemistry Research, 50; 2011, pp. 14162-14167.

Notification of Transmittal of the International Search Report and the Written Opinion of the International Searching Authority dated Sep. 21, 2018 for International Application No. PCT/US2018/036857.

* cited by examiner

MINIMUM BOILING AZEOTROPE OF N-BUTYL-3-HYDROXYBUTYRATE AND N-UNDECANE AND APPLICATION OF THE AZEOTROPE TO SOLVENT CLEANING

BACKGROUND

Increasing concerns over occupational health and safety and stringent regulations against solvent emissions have led to a desire to replace halogenated solvents in cleaning of machined metal parts. Standard replacements for halogenated molecules are formulated from propylene glycol ethers, but these solvents often lack broad solvency for both nonpolar and polar residues that are typically deposited in machining processes.

During machining processes of metal parts, oils and coolants are continuously applied to provide lubrication, cooling and removal of metal slag. Application of these machining fluids imparts improved tool life and enhances part surface finish by reducing metal-to-metal friction, thermal deformation and corrosion. Machining fluids are subdivided into four general categories: straight (or "cutting") oils, soluble (emulsifiable) oils, full-synthetic coolants and semi-synthetic coolants. Straight oils are water immiscible and contain hydrotreated petroleum or mineral oils with a small fraction of polar lubricants (fats, esters, vegetable oils) and extreme pressure additives (typically organo-Cl, -S or -P compounds). Soluble oils are mixtures of 30-85% straight oils blended with surfactant-like emulsifiers. Stable emulsions are prepared by dispersing 3-10% of the soluble oil concentrate in water. Full-synthetic coolants contain no petroleum or mineral oils and are instead formulated from complex mixtures of alkaline inorganic and organic compounds. In order to improve part wetting and fluid performance, full synthetic fluids contain a wide variety of amines, surfactants, lubricants, biocides and corrosion inhibitors. The final working fluid is also prepared by diluting the full synthetic concentrate to 3-10% in water. Semi-synthetic fluids borrow the performance of both soluble oils and full synthetic coolants by blending 5-30% petroleum oil with full synthetic coolant and dispersing the mixture in 50-70% water. The selection of metalworking fluid is based on the desired lubricity and heat transfer performance at expected machining speeds and includes considerations such as metal compatibility and cost. In addition to these fluids, grinding pastes, polishing pastes and lubricating greases containing fatty acids, waxes and metal carbides and oxides are often used in machining processes. Highly acidic rosins, epoxy compounds and polar water-soluble fluxes are also extensively applied in soldering processes.

Subsequent to metalworking processes with any fluid, the machined metal parts can be contaminated with metal chips, oil-based residues, greases, lubricants, pastes and adventitious dust and dirt. Removal of these contaminants is often required prior to further processing (additional machining, painting, plating, heat treatments, assembly, etc.). Failure to clean the machined part can lead to film/coating adhesion difficulties, paint defects, blockage of tight tolerance spaces (threads, holes, etc.) and general poor final product quality. Historically, machined parts were cleaned by the so-called "cold-cleaning" methods—immersion, spraying, or wiping and rinsing in heated solvents. However, concerns with flammability, worker health, solvent emissions and poor cleaning performance and throughput led to the adoption of alternative solvents and methods. The second-generation liquid cleaners were predominately nonflammable halogenated solvents that were, at the time, considered safer replacements. Methylene chloride, trichloroethylene, perchloroethylene and n-propyl bromide were widely adopted as liquid cleaning solvents. Investigation of the long-term effects of these halogenated solvents led to increasing regulations due to toxicity, groundwater contamination and emission concerns. In order to eliminate the inherent environmental, health and safety (EHS) concerns with cold solvent cleaning, aqueous-based cleaning methods were also widely adopted. However, water-detergent based technologies were deficient in cleaning performance due to high water surface tension (~2X of most organic solvents) and the tendency of many contaminants to hydrolyze, forming a difficult to remove soap and glycerol film on parts. In addition, these processes were found to be energy intensive and introduced the need for significant wastewater treatment and disposal.

Due to cleaning limitations with cold-cleaning processes, vapor degreasing was developed to provide enhanced cleaning performance. In a typical vapor degreasing process, the part to be cleaned is suspended in the vapor of a boiling solvent. The hot solvent vapor condenses on the initially cooler part and contaminants are removed by both physical entrainment and dissolution of machining fluid residues. The solvent-contaminant mixture is removed by gravity or mechanical rotation of the part. Once the temperature of the part reaches the vapor temperature, condensation ceases and the cleaning process is terminated. The vapor degreasing process enhances cleaning due to the generally higher cleaning temperatures and the reduced surface tension of the solvent in the vapor phase as compared to liquid. Lower surface tension facilitates solvent penetration into tight recesses of the part that would otherwise be inaccessible. In some instances, the cleaning process is augmented by immersion of the part or spray washing in hot solvent. The immersion cleaning step is often assisted by ultrasonic irradiation to impart a quasi-scrubbing action. Vapor degreasing technologies in use today include Open-Top Vapor Degreasers (OTVD), Closed-Loop Vapor Degreasers (CLVD), Vacuum Vapor Degreasers (VVD) and Airless Vacuum Vapor Degreasers (AVVD). OTVD, although still widely employed for parts cleaning using low boiling solvents, are open to the atmosphere and lead to significant worker exposure issues and large solvent emissions. As a result, solvent selection is critical to balance cleaning performance and EHS considerations along with the need to frequently replenish solvent losses. The other vapor degreasing technologies are inherently safer, closed cleaning systems, but concerns with personnel exposure and fugitive emissions are still present.

In addition to low surface tension, the solvent employed in vapor degreasing must have a vastly different boiling point than the contaminants that are removed to facilitate recovery and re-use of the cleaning solvent. Low water miscibility and resistance to unwanted reactions with water are highly desired to facilitate removal and solvent stability. Inherent water contamination occurs from atmospheric moisture and cleaning of water-based machining fluids. A heavy water layer, containing only a small fraction of solvent, is removed by physical decantation in gravity separators. The lighter solvent-rich layer, containing water to the miscibility limit and part contaminants, is returned to the solvent boiling sump for further use. In typical vapor degreasers, the solvent in the sump is continuously recovered and purified by vacuum distillation. The high boiling contaminants are then removed and the purified solvent is re-used multiple times without large changes in composition, boiling characteristics, or the need to replace or replenish solvent. As a result, the solvent must have a large relative volatility compared to typical machining fluids and exhibit thermal and chemical stability in the presence of these soils and over multiple cleaning and recovery cycles Until the mid-1990s, five single component solvents were traditionally used is vapor degreasing processes: CFC-113, 1,1,1-trichloroethane (TCA), methylene chloride (MC), trichloroethylene (TCE) and perchloroethylene (PCE). Although possessing excellent solvency for both nonpolar and polar contaminants, CFC-113 and TCA were identified as potent ozone depleting chemicals and were subsequently banned. The chlorinated solvents MC, TCE and PCE are still employed but have inherent toxicity and worker exposure concerns, particularly in OTVD applications. As safer replacements for these chlorinated cleaners, several families of EHS compliant solvents were developed: the halogenated paraffinic hydrochlorofluorocarbons (HCFCs) and hydrofluorocarbons (HFCs), fluorinated olefins, halogenated oxygenates such as hydrofluoroethers (HFEs), fluorinated olefinic oxygenates and finally, fluorinated silanes. In recent years, many molecules in the HCFC series of solvents were also identified as ozone depleting and were largely phased out in January 2015 under the Montreal Protocol.

Although some halogenated single solvent systems have acceptable EHS profiles, the solvency of these molecules are largely paraffinic in nature, lacking solvency for soils with large hydrogen bonding and polar Hansen solubility parameters. In a response to increasing regulations and consumer perceptions against chlorinated solvents in particular and halogenated solvents in general, many non-halogenated cleaning solvents were developed that attempt to provide improved polar solvency. These solvents are typically single solvent systems, or simple binary or ternary zeotropic blends based on alcohols and/or glycol ethers, particularly propylene glycol monobutyl ether and propylene glycol monopropyl ether. The so-called "modified alcohol" solvents fulfill the need for nonflammable, low toxicity cleaners with zero ozone depleting potential and low global warming potential. Single solvent systems are simple to use and require no solvent formulation, but typically lack the flexibility of broad solvency for both nonpolar and polar contaminants. As a result, several binary and ternary zeotropic solvent blends were formulated to broaden the cleaning performance with a multi-component solvent. However, these zeotropic blends fractionate upon boiling, enriching the vapor in lower boiling components and modifying the cleaning power in the vapor phase. With solvent losses as vapor, the liquid composition of the solvent blend concentrates in higher boiling components with repeated use, thus modifying the effectiveness and boiling point of the solvent with time. Zeotropic solvent blends thus require regular solvent composition analysis and frequent solvent replacement or replenishment of the lost lower boiling components.

Simple binary and ternary zeotropic solvent blends are extensively employed in vapor degreasing, with the Dowclene™ series of solvents finding wide use. The Dowclene™ solvents are composed of blends of propylene glycol ethers (e.g., Dowclene™ 1601 is propylene glycol monobutyl ether (PnB) and dipropylene glycol dimethyl ether (DMM)). The addition of DMM serves to improve the nonpolar solvency character of PnB by effectively decreasing the polar and hydrogen bonding Hansen solubility parameters of the mixture. As a result, the zeotropic blend of PnB-DMM has a polar and hydrogen bonding solvency contribution due to PnB and a more nonpolar solvency contribution attributed to DMM. The net solvency of the blend, per volumetric blending rules, lies intermediate to both components. However, it is recognized that binary zeotropic degreasing solvents composed of the propylene glycol ethers lack adequate solvency for polar contaminants while depositing an opaque residue on cleaned parts. Similarly, it is known that other vapor degreasing solvents formulated for higher paraffinic solvation ability display poor solvency for polar soils and tend to deposit waxy residues. Binary zeotropic solvents are often re-formulated with addition of a third component to improve polar solvency. Generally, lower alcohols such as ethanol, n-propanol, isopropanol, n-butanol and t-butyl alcohol are employed for this purpose. Again, these solvent systems suffer from fractionation due to solvent emissions and thus require continuous monitoring of solvent composition.

Fractionation of cleaning solvent blends can be eliminated by utilizing a solvent mixture at its azeotropic composition. In this case, the solvent that is boiled has the same vapor composition as in the liquid phase and enrichment of the vapor phase in lower boiling components does not occur. As a result, the solvent blend behaves as a single component system with a constant composition and constant boiling point that cannot be separated by fractionation. Binary, two-component azeotropes are classified as minimum or maximum boiling where the boiling point of the azetrope boils at a temperature lower or higher than either pure component, respectively. Minimum boiling azeotropes can be further categorized as either homogeneous or heterogeneous, where the liquid forms a single phase or two separate phases. Furthermore, many binary azeotropes have compositions that are highly pressure dependent. The Clausius-Clapeyron equation relates the heat of vaporization of a compound to the slope of the vapor pressure curve as a function of temperature. As a result, the azeotropic composition of a blend of components with substantially different heats of vaporization will depend strongly on pressure. Large differences in heats of vaporization permit "breaking" an azeotrope at reduced pressures, analogous to pressure-swing azeotropic distillation. The aforementioned deficiencies with zeotropic solvent blends are introduced when employing pressure-dependent azeotropic solvents at pressures different from the intended conditions. Thus, a solvent formulated for vapor degreasing at one pressure will be far from the azeotrope pinch point at other pressures and effectively behave as a zeotropic solvent. This limits the available operating range of a pressure-dependent azeotropic solvent and necessitates formulation of multiple solvent compositions to tailor the blend to a desired operating pressure. The capability to manipulate operating pressures with maintenance of azeotropic behavior of the solvent is highly desired and lends flexibility to operation of vapor degreasing equipment.

SUMMARY OF INVENTION

A minimum-boiling, binary azeotrope having a linear alkane of at least 9 carbon atoms and an ester alcohol is provided herein. In an embodiment, the linear alkane is n-undecane and the ester alcohol is n-butyl-3-hydroxybutyrate. The azeotrope may be homogenous and it may have 18-23 mole % of the ester alcohol and 77-82 mole % of the linear alkane.

In an alternative embodiment, the azeotrope may be included in a solvent for cleaning machined metal party, wherein the solvent may be a cold-cleaning solvent or a vapor degreasing solvent.

Methods for removing both polar and non-polar contaminants from machined metal parts are also provided herein. These methods involve contacting a machined-metal party with a solvent having the azeotrope of a linear alkane having at least 9 carbon atoms and an ester alcohol.

DETAILED DESCRIPTION

Figure 1:
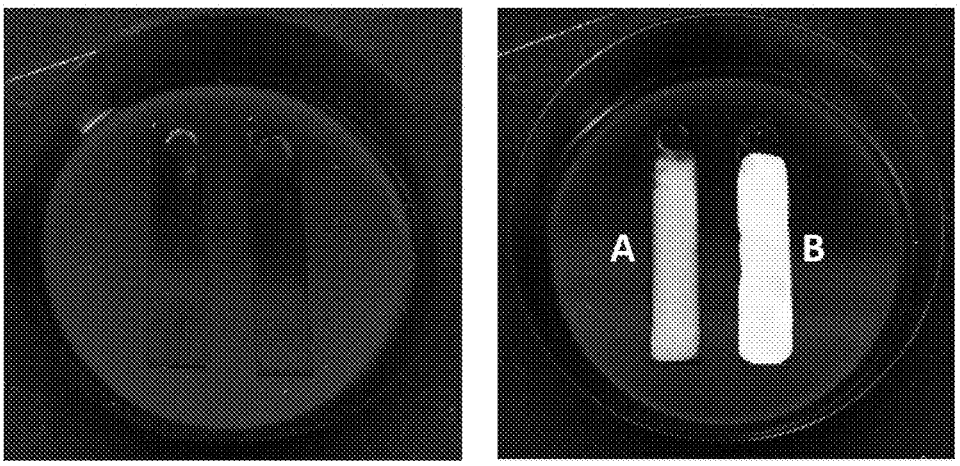
FIG. 1 shows photographs of the blank and soiled aluminum test coupons under ultraviolet irradiation.

As a matter of practicality, solvents for vapor degreasing applications have normal boiling points below approximately 195-200° C. As such, pure n-butyl-3-hydroxybutyrate (Eastman Omnia™), disclosed in U.S. Pat. No. 9,163,202 which is hereby incorporated by reference in its entirety is an ester alcohol with a normal boiling point of 217° C., is not suitable as a single solvent for vapor degreasing. However, it has been unexpectedly discovered that introduction of a second component and formation of a minimum boiling binary azeotrope with n-butyl-3-hydroxybutyrate can facilitate use of the molecule as a vapor degreasing solvent. Minimum boiling azeotropes occur due to liquid phase non-idealties and are manifested as positive deviations (activity coefficients, $\gamma_i>1$) from Raoult's Law that arises from dispersive forces between molecules in a binary liquid mixture. These interactions are governed by properties inherent to molecular structure and include weak Van der Waals forces, nonpolar-polar effects and influences due to hydrogen bonding. Positive deviations from ideality tend to occur when dissimilar molecules are mixed and arise from disruption of hydrogen bonding networks or interactions between polar and nonpolar molecules. Larger differences in the H-bonding characteristics or polar-nonpolar nature or of the molecules lead to larger activity coefficients.

A suitable azeotroping agent for n-butyl-3-hydroxybutyrate can be projected by analysis of the structure of the molecule. The potential and extent of H-bonding character can be qualitatively predicted by classification of the molecular functional groups. The n-butyl-3-hydroxybutyrate molecule has three main functional groups: a secondary alcohol group, an ester functionality and a $C_4$ paraffinic chain connected to the ester oxygen atom. The secondary alcohol functionality is of the H-bond acceptor-donor (HBAD) class and could form a minimum boiling azeotrope with non-bonding (NB) molecules (e.g., paraffins, aprotic halogen salts, thiols, sulfides), molecules with H-bond donating (HBD) groups (e.g., inorganic acids, protic halogen salts), other molecules with HBAD functionalities (e.g., alcohols, glycol ethers, 1° and 2° amines, mono/peracids) and H-bond acceptor (HBA) groups (e.g., ethers, carbonyl compounds, heteroatom aromatics, halogenated paraffins). The ester functionality of n-butyl-3-hydroxybutyrate is of the HBA class and deviations due to H-bonding networks occur with groups from the aforementioned HBAD classification and with molecules containing strongly associative H-bonding (HBSA) groups (e.g., water, 1° and 2° amides, polyacids, polyols, amino alcohols). Although possible, the ester group is less likely to form azeotropes with NB and HBA class functionalities, as these interactions do not affect H-bonding and are likely to be ideal or quasi-ideal. The $C_4$ paraffinic functionality of n-butyl-3-hydroxybutyrate may form an azeotrope by breaking the H-bonding network of molecules with HBSA or HBAD character. Less probable is the formation of a minimum boiling azeotrope with other NB groups and with molecules having HBD or HBA functionalities, as these systems are also likely ideal.

The structure and functional groups present in a molecule also affects polar-nonpolar interactions, with large differences in polarity giving rise to greater deviations from ideality. As a result, the moderately polar alcohol and ester functionalities of n-butyl-3-hydroxybutyrate could be expected to form azeotropes with significantly more polar molecules like water or several nonpolar functionalities. The list of nonpolar groups with which n-butyl-3-hydroxybutyrate may display significant non-ideal binary character include, in increasing order of likelihood: ketones, aldehydes, ethers, aromatics, olefins and paraffins. Furthermore, increased branching of more nonpolar azeotroping molecules with n-butyl-3-hydroxybutyrate will also impart higher nonpolar character. Salts, acids and N- and S-containing molecules were omitted from consideration as components of a vapor degreasing solvent. The compounds most likely to form minimum boiling azeotropes with n-butyl-3-hydroxybutyrate are close boiling molecules of hydrocarbons, ethers (including glycol ethers), halogenated paraffins, alcohols (including polyols), and carbonyl compounds like aldehydes, ketones and other esters. Halogenated paraffins were also not considered as these are typically low boiling compounds. In addition to solvency performance, the binary azeotrope must also satisfy physical property requirements for a degreasing solvent. These properties include boiling point, surface tension, flash point, latent heat of vaporization and resistance to thermal degradation and hydrolytic attack. Furthermore, the solvent must possess excellent material compatibility and a favorable EHS profile, including low toxicity, zero ozone depleting potential (ODP), low global warming potential (GWP), low vapor pressure VOC status and not act as a hazardous air pollutant (HAP).

Described in the present invention is a novel minimum boiling homogeneous azeotrope of n-undecane, a linear alkane, and n-butyl-3-hydroxybutyrate (n-butyl-3-hydroxybutyrate), an ester alcohol, and application of the azeotropic blend to simultaneous degreasing of both nonpolar and polar soils. The alkane component of the azeotrope functions to clean lipophilic contaminants with more nonpolar, water-insoluble character. The ester alcohol molecule of the azeotrope, with ester and alcohol functionalities, serves to provide solvency for hydrophilic water-soluble contaminants. The high hydrogen bonding and polar Hansen solubility parameters of n-butyl-3-hydroxybutyrate exceed the solvating ability of propylene glycol ether-based solvents towards hydrophilic soils. The n-butyl-3-hydroxybutyrate molecule has a unique chemical structure with a very polar ester alcohol functionality and a relatively nonpolar C4 aliphatic chain. The total Hansen solubility parameter of n-butyl-3-hydroxybutyrate exceeds the polar and hydrogen bonding solvency of the propylene glycol ethers and is equivalent to the ethylene glycol ether series of solvents. The highly nonpolar undecane component of the blend imparts greater nonpolar solvency than glycol ethers with aliphatic character like DMM. Furthermore, the amphiphilic nature of n-butyl- 3-hydroxybutyrate diminishes deposition of waxy residues that are characteristic of solvents with high paraffinic character by acting as a pseudo-surfactant. In addition to having good solvency power for both nonpolar and polar soils, the azeotropic blend is nonflammable (flash point>60° C.), non-toxic and not a hazardous air pollutant, with zero ozone depleting potential (ODP) and low global warming potential (GWP).

The existence, composition and boiling point temperature of the azeotrope at isobaric conditions was initially estimated by the Dortmund modified UNIFAC group contribution method. The UNIFAC method uses interactions between characteristic functional groups of each molecule to predict activity coefficients of non-ideal liquid mixtures. The method predicts a minimum-boiling azeotrope with a nearly constant composition of 22 mol % n-butyl-3-hydroxybutyrate and 78 mol % n-undecane over typical vapor degreaser operating pressures. That is, the azeotropic liquid and vapor composition are largely invariant with pressure due to similarities in heats of vaporization of both components of the binary azeotrope. For example, over an operating pressure range of 25-760 Torr, the composition of the azeotrope varies by less than 3 mol %. Since the azeotropic composition does not appreciably change, the liquid solvent as formulated is always, at the very least, near azeotropic and does not enable significant enrichment of the vapor phase with the lighter component. As a result, different blended compositions of n-butyl-3-hydroxybutyrate and n-undecane are not required for operating at different pressures. Moreover, some azeotrope mixtures lose azeotropic behavior all together at reduced pressures. However, the n-butyl-3-hydroxybutyrate—undecane azeotrope retains azeotropic behavior from atmospheric pressure to below 1 Torr of pressure. Such a pressure insensitive azeotrope provides a unique advantage by supplying constant solvency power at any operating pressure and allows for application of the azeotrope to degreasing from pressures below 10 Torr to atmospheric conditions.

The attractive Hansen solubility parameters of the blend permit application of the formulated solvent to cleaning of polar and nonpolar contaminants. As such, the azeotrope can be employed in both cold cleaning applications (immersion, spraying, wiping) and vapor degreasing of machined metal parts. The azetrope has nearly universal compatibility with metals and broad suitability with most elastomers. Furthermore, the azeotrope has boiling points similar to modified alcohol solvents but a lower surface tension, permitting better part penetration in vapor degreasing applications. The low boiling point permits facile recovery of the azeotrope from high boiling contaminants by vacuum distillation. The azeotrope is only partially miscible with water, with pure component n-butyl-3-hydroxybutyrate displaying solubility up to 3.9% water, while undecane is completely immiscible. At the azeotropic composition, the miscibility limit of water in the solvent blend at 25° C. is only 0.20-0.25 wt. %. As a result, water contamination is easily removed by conventional gravity decantation methods and the ester functionality of n-butyl-3-hydroxybutyrate is largely protected from hydrolytic degradation.

Example 1—Vapor-Liquid Equilibrium Measurements

The true azeotropic composition was determining by measuring activity coefficients at infinite dilution. The non-idealities of the liquid solution were measured under isobaric conditions at 100 Torr assuming ideal vapor behavior by a differential ebulliometry technique. Samples of highly pure (>99.5 wt. %) n-undecane and n-butyl-3-hydroxybutyrate both available from Eastman Chemical Company in Kingsport, Tenn. were used for the measurements. Prior to analysis, the pure liquid samples were dried over calcium sulfate desiccant (Drie-rite) for one week. For measurement of the infinite dilution activity coefficients of n-butyl-3-hydroxybutyrate in n-undecane solvent, 150 mL samples of n-undecane were charged to two equilibrium boiling stills (ebulliometers) connected in parallel to a single pressure manifold through a ballast tank. Pressure was maintained at 100 Torr absolute via a Ruska pressure controller. The boiling chambers were vacuum insulated and silvered and the liquid contents were stirred with magnetic Teflon stir bars. Vapor temperatures above the boiling liquids were measured via centrally-placed thermowells containing calibrated platinum resistance thermometers. Heating of the still pots was accomplished by cartridge heaters that were supplied by rheostats connected to Eurotherm temperature controllers. One ebulliometer always contained pure solvent ('reference' still) while small (Table 9) calibrated additions of solute were made to the second ebulliometer ('addition' still) through a septum-sealed injection port. The temperatures and pressures of both ebulliometers were continuously monitored and small changes in the liquid boiling point in the addition still were recorded after each solute injection. Boiling point changes were noted after re-establishment of equilibrium as indicated by stable temperatures and pressures. Temperature changes were measured with a span of less than 0.05° C. and averaged over a recording time of 5 minutes. The solute addition, equilibration and boiling point difference measurement was repeated 5-6 times. The experiment was repeated for n-undecane solute infinitely diluted in n-butyl-3-hydroxybutyrate solvent to define the activity coefficients for both components.

The limiting activity coefficients for each component were regressed to the Wilson equation by measuring the small changes in boiling point temperatures of solvent that result from additions of accurately weighed injections of solute (to within ±0.001 g). Temperature changes were plotted versus mole fraction of solute and the slope of the plot with the saturated vapor pressures were used to calculate the infinite dilution activity coefficients. Wilson parameters at 100 Torr were calculated directly from the measured activity coefficients at infinite dilution. Regression of the Wilson equation parameters at infinite dilution allows for prediction of the activity coefficients for each component over the entire composition range. Calculation of the binary VLE by using the Wilson equation activity coefficient model confirms the existence of a minimum boiling azeotrope at a composition of 19.56 mol % n-butyl-3-hydroxybutyrate and 80.44 mol % n-undecane, in good agreement with the UNIFAC prediction. The ebulliometry data and regressed parameters are in Appendix A.

Example 2—Vapor Degreasing of Straight Oil by Weight Loss

The cleaning efficacy of the n-butyl-3-hydroxybutyrate—undecane azeotrope was first tested against a highly nonpolar heavy straight oil (Castrol MolyDee) containing refined petroleum oil, paraffin waxes as lubricants and chlorinated paraffins as high pressure additive. As a comparison, neat n-undecane and a zeotropic blend of PnB-DMM containing a lower alcohol additive to increase polar solvency were tested as standards. For each experiment, a coating of the straight oil was added to 1 cm×5 cm×0.2 mm aluminum test coupons and baked on in an 80° C. oven for 16 hrs. For vapor degreasing testing, the cleaning solvent was added to a 2 L thermostatically-jacket glass test reactor. Heating of the solvent was controlled by circulating a high temperature heat transfer fluid through the jacket and vacuum was supplied by a diaphragm-style vacuum pump. Multiple test coupons could be suspended in the vapor space and tested simultaneously. Cleaning efficiency was quantitated by total weight loss of oil contaminant from the aluminum coupons. A total of ten total coupons for each test were used to determine the average weight loss and the standard error in the measurements. For each test, the solvent was pre-heated to the boiling point temperature at the expected operating pressure. The ten pre-weighed coupons were then suspended in the vapor space of the reactor and the pressure rapidly reduced to either 300 or 100 Torr. Once at pressure, the vapor degreasing process was conducted for 15 minutes under total reflux of the solvent. After the elapsed cleaning time, the reactor was backfilled with room air and the test coupons were removed. The just-cleaned dry coupons were immediately weighed to determine the total weight loss of straight oil. Subsequently, visual inspections of the coupons were made to determine the presence of any deposits and each test strip was wiped with a lint-free white cloth to further visualize residual contaminants. The test coupons were also examined by the water break test. Due to the surface tension of water, the presence of residual nonpolar contaminants will cause water to form discrete beads. Conversely, water will flow off the part in a continuous film from a fully cleaned surface. This test was conducted by submerging the piece in distilled water and allowing water to drain from the vertically-oriented test coupon for 15 s. The presence of water break was determined by simple visual inspection. After these subsequent qualitative tests, the coupons were thoroughly cleaned with acetone, hexane and toluene prior to measuring the weight of the blank, unsoiled coupons for weight loss calculations. Table 1 shows the cleaning efficiency results for the three tested solvents for removal of the straight oil contaminant.

TABLE 1

Cleaning Results of a Straight Oil with Tested Solvents

| Cleaning Solvent | P (Torr) | $T_{boil}$ (° C.) | Cleaning Efficiency (%) | Appearance |
|---|---|---|---|---|
| PnB-DMM blend + R'OH | 300 | 133 | 98.3 ± 0.7 | shiny; free of residue; no water break |
| Omnia ™-undecane azeotrope | | 158 | 98.0 ± 1.3 | shiny; free of residue; no water break |
| neat n-undecane | | 163 | 95.4 ± 0.4 | hazy; slight residue; positive water break |
| PnB-DMMblend + R'OH | | 101 | 98.5 ± 0.4 | shiny; free of residue |
| Omnia ™-undecane azeotrope | 100 | 125 | 99.9 ± 0.1 | shiny; free of residue |
| neat n-undecane | | 128 | 96.6 ± 0.1 | hazy; slight residue; positive water break |

At 300 Torr, the modified PnB-DMM blend and the n-butyl-3-hydroxybutyrate—undecane azeotrope cleaned with similar efficiency, in agreement with the observations of clean, residue free surfaces exhibiting no water break. Similar to literature observations, the neat-undecane solvent cleaned with less efficiency and a noticeable, white hazy residue was deposited on the test coupon surfaces. A positive test for water break was also observed on coupons after cleaning with only n-undecane. After cleaning at 100 Torr, the n-butyl-3-hydroxybutyrate—undecane azeotrope cleaned with slightly higher performance than the modified PnB-DMM blend, although both surfaces appeared clean and residue free with further qualitative testing. Again, a waxy residue was observed on the surface of the aluminum coupons cleaned with neat n-undecane.

Examples 3-4—Cleaning Performance by Ultraviolet Fluorescence

The cleaning performance of the n-butyl-3-hydroxybutyrate—undecane azeotrope was further evaluated in degreasing of two additional contaminants by fluorescence measurements. Many organic materials in common metal-working soils fluoresce when exposed to ultraviolet radiation. For these measurements, an ultra-heavy duty straight oil (Comminac SCS27) and an emulsifiable oil (Starsol 775AL) were selected. The straight oil is largely nonpolar in nature while the emulsifable/soluble oil contains a number of highly polar amine-based additives and sodium sulfonate surfactants. The n-butyl-3-hydroxybutyrate—undecane azeotrope of the present invention was tested against a PnB-DMM binary blend and a PnB-DMM blend modified with an additional alcohol additive for improved polar solvency. In a similar fashion to previous testing, a coating of the oil contaminant was applied to aluminum test coupons and dried on overnight at room temperature. Before application of the soil and prior to cleaning, the test coupons were placed under a blacklight and a high resolution photograph at close range was taken. The soiled test coupons were then subjected to one of two cleaning steps: cleaning by immersion in the hot solvent at atmospheric pressure for 2 minutes followed by 3 minutes of vapor degreasing at 100 Torr, or a 5 minute cleaning time by vapor degreasing only (also at 100 Torr). Immediately after the prescribed cleaning treatment, the dry test coupons were again placed under a blacklight and photographed.

FIG. 1 shows typical photographs of the blank and soiled aluminum test coupons under ultraviolet irradiation.

The left panel shows the blank unsoiled test coupons while the right panel shows representative panels completely soiled with contaminant. In the inset of the right photograph, label A designates the straight oil soil while label B identifies the soluble emulsifiable oil. Using a pixel counting software, the ultraviolet fluorescence intensity was determined and corrected for background fluorescence. Table 2 shows the averages of the mean and maximum background-corrected intensities representative of the blank and soiled coupons.

TABLE 2

Average Values of Fluorescence Intensities of Blank and Soiled Test Coupons

| | Fluorescence Intensity (a.u.) | | |
|---|---|---|---|
| | Mean | Maximum | Condition |
| Blank A1 test coupons | <60 | <150 | Clean |
| Heavy straight oil (A) | 155 | 215 | Unclean |
| Emulsifiable oil (B) | 206 | 255 | Unclean |

The mean and maximum fluorescence intensities of the unsoiled blank coupons were consistently below values of 60 and 150, respectively. As a result, these limits were assumed as cleanliness boundaries and measured intensities below these values indicate a clean part.

Figure 2:
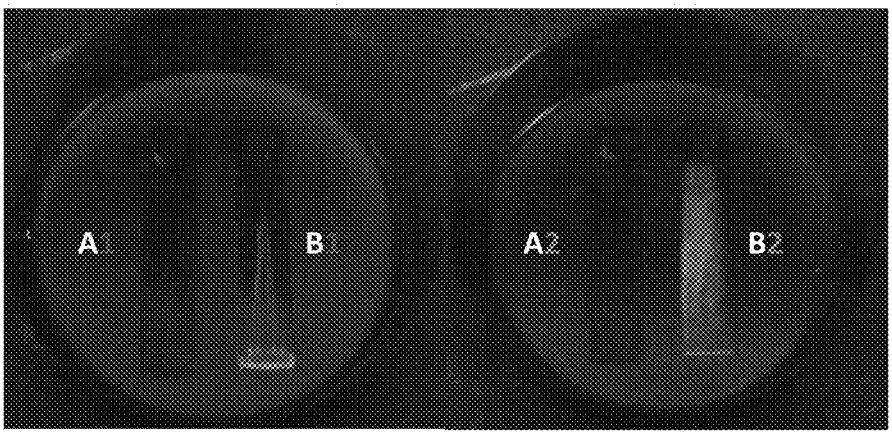
FIG. 2 shows demonstrates the post-cleaning results of the PnB-DMM binary blend.

FIG. 2 demonstrates the post-cleaning results of the PnB-DMM binary blend. Labels A and B again designate the contaminant type while test 1 signifies the combined immersion-vapor degreasing (left panel) and test 2 a vapor degreasing only protocol (right panel).

By visual inspection, the PnB-DMM blend appears to thoroughly clean the nonpolar soil (A1 and A2) by both cleaning methods. PnB is formulated with DMM to improve nonpolar solvency and the solvent performs well at removing the straight oil. However, noticeable fluorescent residue remains on the test coupons soiled with a more polar emulsifable oil, regardless of the cleaning method. As expected, a combination cleaning step of immersion and vapor degreasing (B1) yields better cleaning performance than vapor degreasing alone (B2). These qualitative results are in agreement with the direct quantitative measurements of fluorescence intensity as presented in Table 3.

TABLE 3

Fluorescence Intensities of Post-Cleaned Coupons with PnB-DMM Blended Solvent

| | Fluorescence Intensity (a.u.) | | |
|---|---|---|---|
| | Mean | Maximum | Condition |
| Straight Oil + Immersion + Vapor (A1) | ≤60 | ≤150 | Clean |
| Soluble Oil + Immersion + Vapor (B1) | 68 | 194 | Unclean |
| Straight Oil + Vapor Only (A2) | ≤60 | ≤150 | Clean |
| Soluble Oil + Vapor Only (B2) | 85 | 183 | Unclean |

Figure 3:
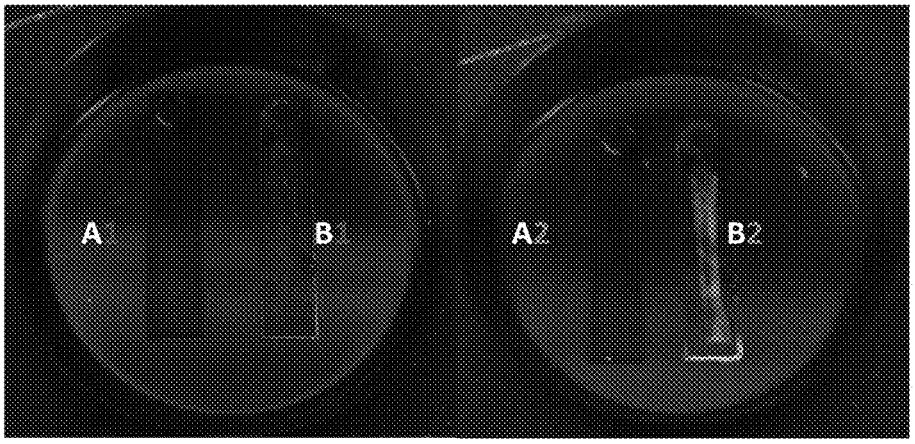
FIG. 3 shows the post-cleaning outcome of the aluminum test coupons degreased with the PnB-DMM+R'OH solvent.

The cleaning performance of the simple PnB-DMM solvent was compared directly to a PnB-DMM blend modified with an alcohol for improved polar solvency. FIG. 3 shows the post-cleaning outcome of the aluminum test coupons degreased with the PnB-DMM+R'OH solvent.

The PnB-DMM azeotrope with an alcohol additive again performs well for cleaning the straight oil (A1 and A2), presumably by the PnB-DMM solvency of the mixture. Visual inspection of cleaning efficacy for the more polar soluble oil (B1 and B2) reveals improved degreasing capability over the more lipophilic unmodified PnB-DMM solvent. However, by vapor degreasing alone, the presence of fluorescent residue is readily apparent. Table 4 displays the post-cleaning fluorescence measurements for degreasing with PnB-DMM+R'OH.

TABLE 4

Fluorescence Intensities of Post-Cleaned Coupons with PnB-DMM + R'OH Solvent

| | Fluorescence Intensity (a.u.) | | |
|---|---|---|---|
| | Mean | Maximum | Condition |
| Straight Oil + Immersion + Vapor (A1) | ≤60 | ≤150 | Clean |
| Soluble Oil + Immersion + Vapor (B1) | ≤60 | ≤150 | Clean |
| Straight Oil + Vapor Only (A2) | ≤60 | ≤150 | Clean |
| SolubleOil + Vapor Only (B2) | 78 | 246 | Unclean |

Figure 4:
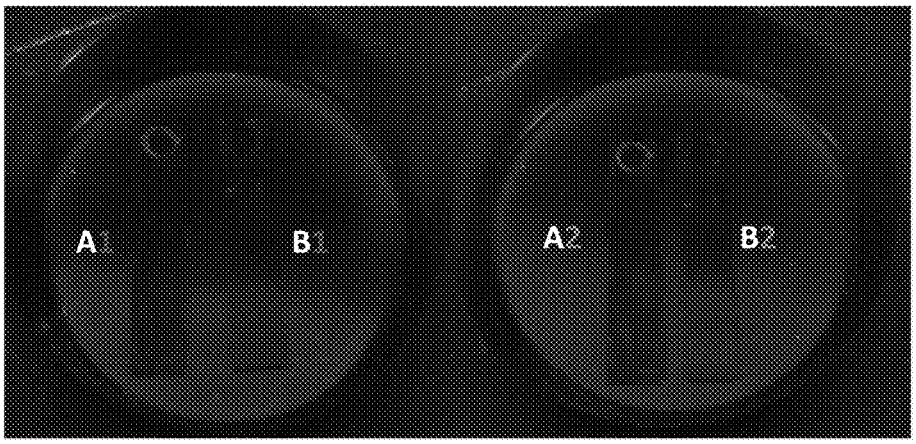
FIG. 4 shows the post-cleaning degreasing performance of the novel n-butyl-3-hydroxybutyrate—undecane azeotrope.
Figure 5:
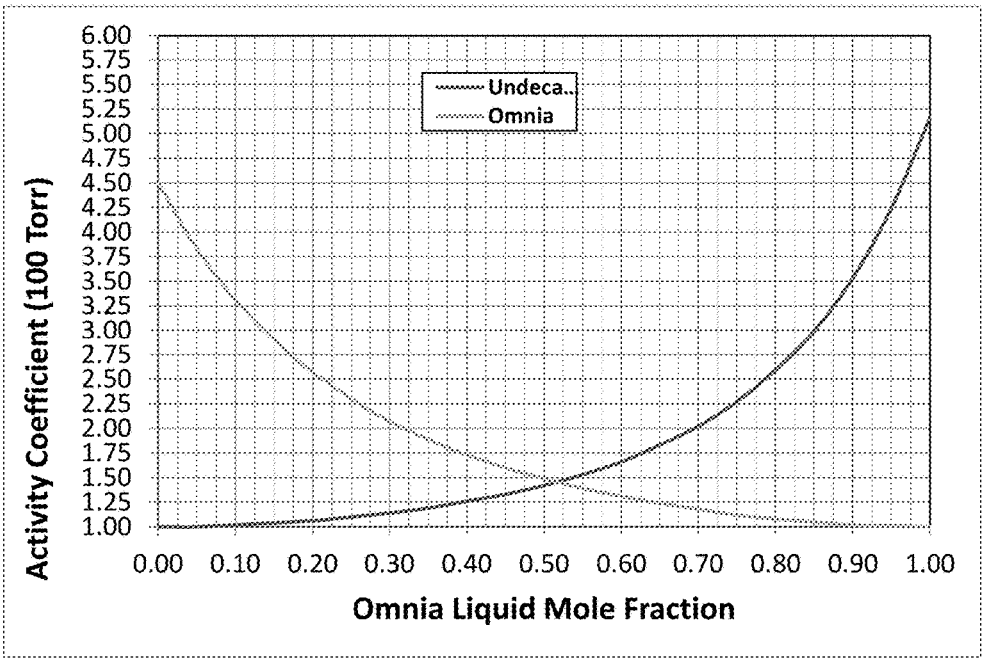
FIG. 5 shows activity Coefficients for n-butyl-3-hydroxybutyrate—Undecane at 100 Torr by the Wilson Equation.
Figure 6:
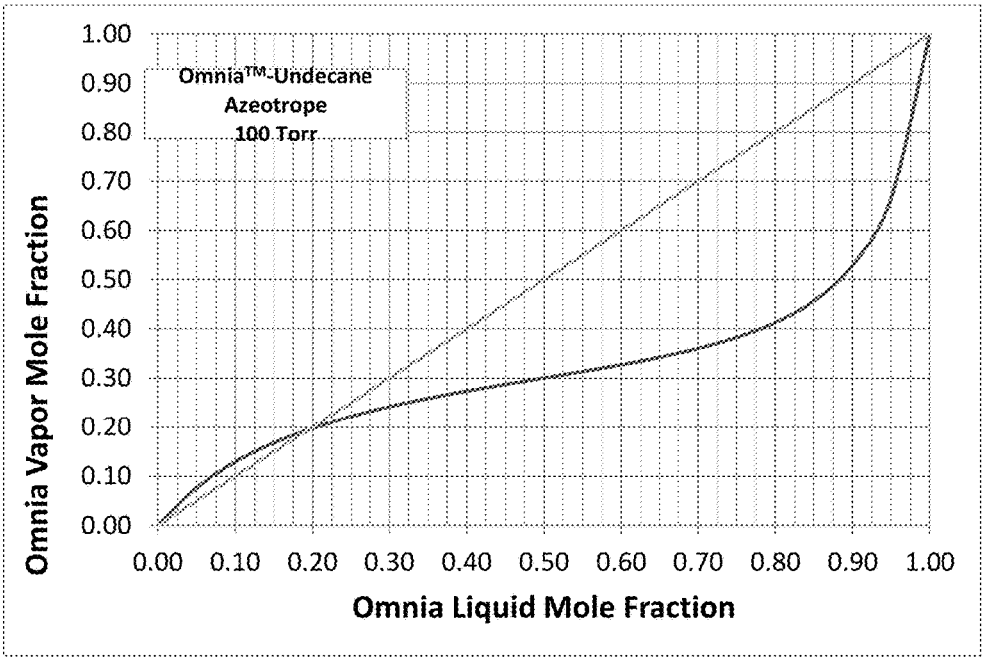
FIG. 6 shows Y-X Diagram for n-butyl-3-hydroxybutyrate—Undecane at 100 Torr.
Figure 7:
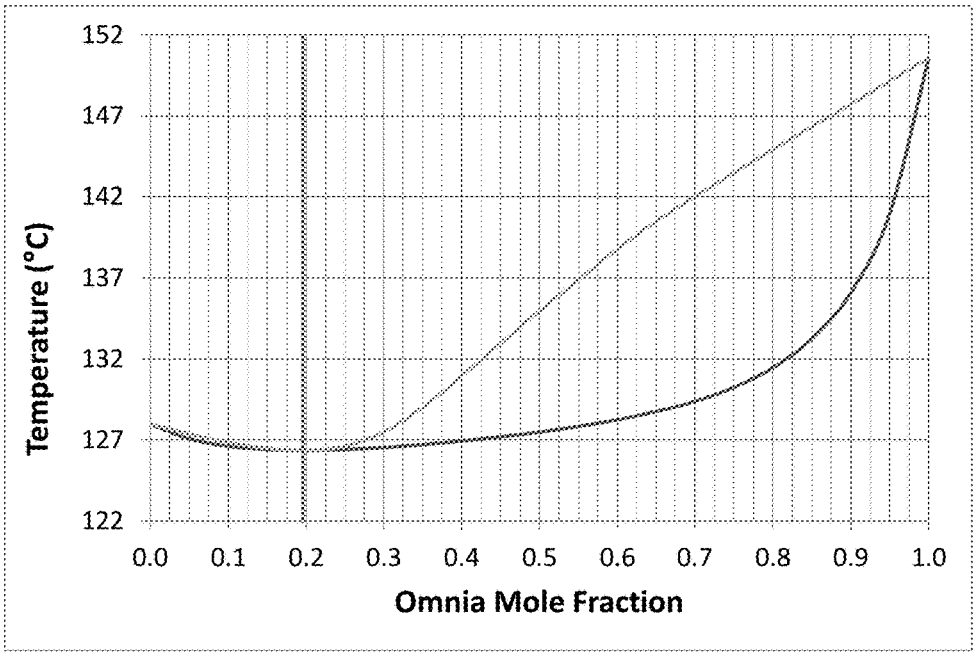
FIG. 7 shows T-x-y Diagram for n-butyl-3-hydroxybutyrate—Undecane at 100 Torr.

The quantitative fluorescence results agree with the conclusions reached by visual inspection of the cleaned test coupons. The added polar solvency resulted in noticeable improvement over the unmodified PnB-DMM blend, although the more polar soluble oil was not completely removed solely by vapor degreasing. The post-cleaning degreasing performance of the novel n-butyl-3-hydroxybutyrate—undecane azeotrope is displayed in FIG. 4.

From visual inspection, the n-butyl-3-hydroxybutyrate—undecane azeotrope appears to clean both nonpolar and polar contaminants equally well, showing improved polar solvency compared to the PnB-DMM blend and the alcohol modified solvent. No fluorescent residue is perceptible on any cleaned test coupons, suggesting broad solvency for both types of soils. Furthermore, the n-butyl-3-hydroxybutyrate—undecane azeotrope appears to successfully clean the test coupons by vapor degreasing alone, a marked improvement over the two control solvents. As shown in Table 5, the fluorescence measurements agree with the visual observations of the novel azeotrope degreasing performance.

TABLE 5

Fluorescence Intensities of Post-Cleaned Coupons with n-buty1-3-hydroxybutyrate - Undecane Azeotrope Solvent

| | Fluorescence Intensity (a.u.) | | |
|---|---|---|---|
| | Mean | Maximum | Condition |
| Straight Oil + Immersion + Vapor (A1) | ≤60 | ≤150 | Clean |
| Soluble Oil + Immersion + Vapor (B1) | ≤60 | ≤150 | Clean |
| Straight Oil + Vapor Only (A2) | ≤60 | ≤150 | Clean |
| Soluble Oil + Vapor Only (B2) | ≤60 | ≤150 | Clean |

Example 5—Hydrolytic Stability of n-Butyl-3-Hydroxybutyrate—Undecane Azeotrope The carbonyl carbons of esters are susceptible to nucleophilic attack by water to form the corresponding alcohol and carboxylic acid by the process of hydrolysis. For n-butyl-3-hydroxybutryate (n-butyl-3-hydroxybutyrate), the molecule will hydrolyze to n-butanol and 3-hydroxybutyric acid. After production, the ester alcohol contains nearly 1-2 wt. % water from the synthesis process. In order to determine the hydrolytic stability of n-butyl-3-hydroxybutyrate, the n-butyl-3-hydroxybutyrate—undecane azeotrope was subjected to repeated boiling-cooling cycles. For each cycle, the azeotrope was refluxed (at ~160° C.) for 1 hour at 300 Torr and subsequently cooled to room temperature. After each cycle, a small sample of the azeotrope was collected and analyzed by gas chromatography for the presence of hydrolysis products. Over five cycles, no evidence of n-butyl-3-hydroxybutyrate hydrolysis products were detected. Table 6 shows the normalized compositions of n-butyl-3-hydroxybutyrate (nBHB), water and the hydrolysis products n-butanol (n-BuOH) and 3-hydroxybutyric acid (3-HBA) after each cycle.

TABLE 6

Ester Hydrolysis of n-butyl-3-hydroxybutyrate - Undecane Azeotrope

| | Component (Normalized wt.%) | | | |
|---|---|---|---|---|
| Cycle | nBHB | Water | n-BuOH | 3-HBA |
| 1 | 97.97 | 2.01 | 0.01 | 0.01 |
| 2 | 98.15 | 1.80 | 0.05 | 0.00 |
| 3 | 98.11 | 1.82 | 0.07 | 0.00 |
| 4 | 98.12 | 1.81 | 0.07 | 0.00 |
| 5 | 98.13 | 1.82 | 0.05 | 0.00 |

The results of Table 6 show no evidence of significant ester hydrolysis. The small presence of n-butanol is an impurity present from the manufacture of n-butyl-3-hydroxybutyrate. No evidence for formation of 3-hydroxybutyric acid was observed. Furthermore, the amount of intrinsic water present in the samples is near the saturation point of n-butyl-3-hydroxybutyrate and representative of typical upper limits of water contamination in solvent cleaning.

Example 6—Acid Hydrolysis Stability of n-Butyl-3-Hydroxybutyrate—Undecane Azeotrope Extreme pressure additives are often supplemented to machining oils in order to provide improved lubrication during high pressure machining processes. These additives chemically react with the microscopic asperities of the metallic surface at high pressures to form a smooth sacrificial film that prevents deleterious friction. Extreme pressure additives are typically organic phosphorus, sulfur or chlorine compounds and include species such as polysulfides, sulfurized hydrocarbons and chlorinated paraffins, respectively. Chlorinated hydrocarbons are widely used as lubricating additives but are known to readily hydrolyze to form HCl in the presence of water and high temperatures, both during machining and degreasing processes. The generation of HCl leads to rapid corrosion of the metal parts and cleaning solvents are often augmented with amine-based stabilizers to neutralize the acid. The presence of HCl can also catalyze the acid-promoted hydrolysis of n-butyl-3-hydroxybutyrate. In order to determine the acid hydrolysis stability of the n-butyl-3-hydroxybutyrate—undecane azeotrope, a highly chlorinated straight oil (Prodraw 2300) containing chlorinated paraffins was added to the azeotrope at a concentration of 1 wt. %. The contaminated solvent was then refluxed at 100 Torr (~125° C.). Samples of the solvent were collected at 2, 4, 6 and 24 hours of reflux time and analyzed by gas chromatography for the presence of hydrolysis products. Table 7 shows the results for detection of hydrolysis products of n-butyl-3-hydroxybutyrate.

TABLE 7

Acid Hydrolysis Stability of n-butyl-3-hydroxybutyrate-Undecane Azeotrope

| Reflux | Component (Normalized wt. %) | | | | |
|---|---|---|---|---|---|
| Time (hr) | nBHB | Undecane | Water | n-BuOH | 3-HBA |
| 2 | 21.89 | 78.10 | 0.08 | 0.01 | 0.00 |
| 4 | 21.97 | 78.03 | 0.00 | 0.00 | 0.00 |
| 6 | 21.93 | 78.07 | 0.05 | 0.00 | 0.00 |
| 24 | 21.96 | 78.04 | 0.00 | 0.00 | 0.00 |

The results in Table 7 reveal no evidence of acid promoted hydrolysis of n-butyl-3-hydroxybutyrate in the presence of a highly chlorinated straight oil. No formation of the n-butyl-3-hydroxybutyrate hydrolysis products, n-butanol and 3-hydroxybutyric acid, were detected, even after 24 hours at elevated temperatures.

Example 7—Water Miscibility in n-Butyl-3-Hydroxybutyrate—Undecane Azeotrope

The discovery that the ester functionality of the n-butyl-3-hydroxybutyrate molecule was largely resistant to hydrolytic attack in both the presence of water and hydrolyzed chlorinated paraffins was an interesting discovery. The hydrolytic decomposition of esters to their corresponding alcohol and carboxylic acid substituents is typically a facile process. However, in the presence of low water concentrations in the organic phase, such reactions are typically suppressed. The actual concentration of water in the n-butyl-3-hydroxybutyrate—undecane azeotrope was investigated further by mixing the azeotrope with an appreciable amount of water past the miscibility limit. A 100 g sample of the azeotrope was prepared by mixing 80.05 g of dry n-undecane with 19.95 g of dry n-butyl-3-hydroxybutyrate. To this mixture, 10.00 g of water was added slowly, immediately forming a second heavy water layer. After the full water addition, the mixture was gently stirred for 2 hours at room temperature to allow for equilibration between the two liquid layers. After settling, a sample of each layer was collected. The heavy water layer was analyzed by gas chromatography while the lighter organic layer was analyzed by Karl Fischer titration. Table 8 below shows the partitioning of n-butyl-3-hydroxybutyrate and undecane into the heavy water layer, as analyzed by GC, and the total water content of the lighter organic azeotrope phase, by Karl Fischer titration.

TABLE 8

Phase Partitioning of n-butyl-3-hydroxybutyrate - Undecane Azeotrope + Water

| | Component (Normalized Wt.%) | | |
|---|---|---|---|
| Layer | nBHB | Undecane | Water |
| top (by KF titration) | — | — | 0.22 |
| bottom (by GC) | 3.17 | 0.07 | 97.76 |

The bottom water layer contains a very small amount of n-undecane and n-butyl-3-hydroxybutyrate partitions to the water phase to the known solubility of n-butyl-3-hydroxybutyrate in water (~3.0-3.5 wt. %). The amount of water in the lighter organic phase is only ~0.22 wt. % at equilibrium. As a result, the presence of water tramp solvent in vapor degreasing can be easily removed by decantation. Furthermore, the low amount of water present in the organic phase may suppress the hydrolytic decomposition of the n-butyl-3-hydroxybutyrate ester functionality, due to the high hydrophobicity of the solvent phase.

Appendix A—n-Butyl-3-Hydroxybutyrate—Undecane Vapor Liquid Equilibrium Data and Plots

TABLE 9

Ebulliometry Data at 100 Torr

| T(° C.) | ΔT (° C.) | mol% Undecane |
|---|---|---|
| 150.942 | 0.000 | 0.00 |
| 149.062 | −1.880 | 0.74 |
| 148.132 | −2.810 | 1.12 |
| 147.182 | −3.760 | 1.50 |
| 146.397 | −4.545 | 1.87 |
| 145.822 | −5.120 | 2.22 |
| 127.213 | −0.740 | 95.71 |
| 127.321 | −0.632 | 96.54 |
| 127.450 | −0.503 | 97.39 |
| 127.590 | −0.363 | 98.24 |
| 127.758 | −0.195 | 99.11 |
| 127.953 | 0.000 | 100.00 |

TABLE 10

Calculated VLE for n-butyl-3-hydroxybutyrate (2) - Undecane (1) Azeotrope at 100 Torr

| T(° C.) | $x_1$ | $y_1$ | $x_2$ | $y_2$ | $\gamma_1$ | $\gamma_2$ |
|---|---|---|---|---|---|---|
| 150.59 | 0.0000 | 0.0000 | 1.0000 | 1.0000 | 5.16 | 1.00 |
| 140.97 | 0.0500 | 0.3340 | 0.9500 | 0.6660 | 4.24 | 1.01 |
| 136.08 | 0.1000 | 0.4709 | 0.9000 | 0.5291 | 3.53 | 1.02 |
| 133.25 | 0.1500 | 0.5429 | 0.8500 | 0.4571 | 2.99 | 1.05 |
| 131.47 | 0.2000 | 0.5871 | 0.8000 | 0.4129 | 2.59 | 1.08 |
| 130.26 | 0.2500 | 0.6172 | 0.7500 | 0.3828 | 2.27 | 1.12 |
| 129.39 | 0.3000 | 0.6396 | 0.7000 | 0.3604 | 2.02 | 1.18 |
| 128.74 | 0.3500 | 0.6575 | 0.6500 | 0.3425 | 1.83 | 1.24 |
| 128.23 | 0.4000 | 0.6728 | 0.6000 | 0.3272 | 1.66 | 1.31 |
| 127.82 | 0.4500 | 0.6865 | 0.5500 | 0.3135 | 1.53 | 1.39 |
| 127.47 | 0.5000 | 0.6997 | 0.5000 | 0.3003 | 1.42 | 1.49 |
| 127.18 | 0.5500 | 0.7128 | 0.4500 | 0.2872 | 1.33 | 1.60 |
| 126.92 | 0.6000 | 0.7265 | 0.4000 | 0.2735 | 1.26 | 1.73 |
| 126.70 | 0.6500 | 0.7415 | 0.3500 | 0.2585 | 1.19 | 1.89 |
| 126.52 | 0.7000 | 0.7584 | 0.3000 | 0.2416 | 1.14 | 2.07 |

TABLE 10-continued

Calculated VLE for n-butyl-3-hydroxybutyrate (2) - Undecane (1) Azeotrope at 100 Torr

| T(° C.) | $x_1$ | $y_1$ | $x_2$ | $y_2$ | $\gamma_1$ | $\gamma_2$ |
|---|---|---|---|---|---|---|
| 126.40 | 0.7500 | 0.7782 | 0.2500 | 0.2218 | 1.10 | 2.30 |
| 126.35 | 0.8000 | 0.8021 | 0.2000 | 0.1979 | 1.06 | 2.57 |
| 126.35 | 0.8044 | 0.8044 | 0.1956 | 0.1956 | 1.06 | 2.59 |
| 126.40 | 0.8500 | 0.8320 | 0.1500 | 0.1680 | 1.04 | 2.90 |
| 126.60 | 0.9000 | 0.8709 | 0.1000 | 0.1291 | 1.02 | 3.31 |
| 127.06 | 0.9500 | 0.9238 | 0.0500 | 0.0762 | 1.00 | 3.83 |
| 127.95 | 1.0000 | 1.0000 | 0.0000 | 0.0000 | 1.00 | 4.50 |

The invention claimed is:

1. A minimum-boiling, binary azeotrope comprising a linear alkane comprised of at least 9 carbon atoms and an ester alcohol.

2. The azeotrope according to claim 1, wherein the linear alkane comprises n-undecane.

3. The azeotrope according to claim 1, wherein the ester alcohol comprises n-butyl-3-hydroxybutyrate.

4. The azeotrope according to claim 1, which is homogeneous.

5. The azeotrope according to claim 1, which comprises 18-23 mole % of the ester alcohol and 77-82 mole % of the linear alkane.

6. A solvent for cleaning machined metal parts, the solvent comprising the azeotrope according to claim 1.

7. The solvent according to claim 6, comprising a cold-cleaning solvent.

8. The solvent according to claim 6, comprising a vapor degreasing solvent.

9. A method for cleaning a machined metal part, comprising contacting the machined metal part with the solvent according to claim 7.

10. A method for cleaning a machined metal part, comprising exposing the machined metal part to the vapor of the solvent according to claim 8.

11. The method according to claim 9, which removes both polar and nonpolar contaminants from the machined metal part.

12. The method according to claim 10, which removes both polar and nonpolar contaminants from the machined metal part.

* * * * *